US007808441B2

(12) United States Patent
Parsche et al.

(10) Patent No.: US 7,808,441 B2
(45) Date of Patent: Oct. 5, 2010

(54) POLYHEDRAL ANTENNA AND ASSOCIATED METHODS

(75) Inventors: Francis Eugene Parsche, Palm Bay, FL (US); Dennis Lee Tebbe, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 628 days.

(21) Appl. No.: 11/847,479

(22) Filed: Aug. 30, 2007

(65) Prior Publication Data

US 2010/0066627 A1 Mar. 18, 2010

(51) Int. Cl.
*H01Q 9/28* (2006.01)
*H01Q 13/00* (2006.01)

(52) U.S. Cl. ..... 343/807; 343/773

(58) Field of Classification Search ..... 343/773, 343/807, 808, 866, 867
See application file for complete search history.

(56) References Cited

U.S. PATENT DOCUMENTS

| | | | | |
|---|---|---|---|---|
| 609,154 | A | 8/1898 | Lodge | |
| 2,175,252 | A | 10/1939 | Carter | |
| 3,656,166 | A * | 4/1972 | Klopach et al. | 343/756 |
| 3,829,863 | A * | 8/1974 | Lipsky | 343/773 |
| 3,987,456 | A * | 10/1976 | Gelin | 343/830 |
| 6,414,647 | B1 | 7/2002 | Lee | 343/793 |
| 7,079,081 | B2 | 7/2006 | Parsche et al. | 343/767 |
| 7,453,414 | B2 * | 11/2008 | Parsche | 343/866 |
| 2006/0238434 | A1 | 10/2006 | Parsche et al. | 343/795 |
| 2007/0159408 | A1 | 7/2007 | Parsche | 343/866 |

FOREIGN PATENT DOCUMENTS

| | | |
|---|---|---|
| EP | 0470271 | 2/1992 |
| EP | 1542314 | 6/2005 |
| GB | 2125226 | 2/1984 |
| GB | 2 302 990 | * 2/1997 |
| WO | WO 9714193 | 4/1997 |

OTHER PUBLICATIONS

Barrow et al., "Biconical Electromagnetic Horns", Proceedings of the I.R.E., Dec. 1939, p. 769-779.

* cited by examiner

*Primary Examiner*—Hoang V Nguyen
(74) *Attorney, Agent, or Firm*—Allen, Dyer, Doppelt, Milbrath & Gilchrist, P.A.

(57) ABSTRACT

The antenna includes an electrically conductive antenna body having a polyhedral shape with opposing first and second ends and a medial portion therebetween. The medial portion of the electrically conductive antenna body is wider than the opposing first and second ends thereof, and the electrically conductive antenna body has a slot therein extending from at least adjacent the first end to at least adjacent the second end. The polyhedral antenna has an omnidirectional pattern, is horizontally polarized and broad in bandwidth above a lower cutoff frequency.

19 Claims, 8 Drawing Sheets

POLYHEDRAL ANTENNA AND ASSOCIATED METHODS

FIELD OF THE INVENTION

The present invention relates to the field of antennas, and more particularly, this invention relates to omnidirectional antennas, slot antennas, horizontal polarization antennas, radar scattering, and related methods.

BACKGROUND OF THE INVENTION

An antenna is a transducer that converts radio frequency electric current to electromagnetic waves that are then radiated into space. The antenna may also convert electromagnetic waves into electric current, or even be a reflector of waves like a RADAR target. The electric field or "E" plane determines the polarization or orientation of the radio wave. In general, most antennas radiate either linear or circular polarization.

A linearly polarized antenna radiates in one plane. In a circularly polarized antenna, the plane of polarization rotates in a circle making one complete revolution during one period of the wave. An antenna is said to be vertically polarized (linear) when its electric field is perpendicular to the Earth's surface. An example of a vertical antenna is a broadcast tower for AM radio or the "whip" antenna on an automobile.

Linear horizontally polarized antennas, such as dipole turnstiles, small wire loops and slotted cylinders, have their electric field parallel to the Earth's surface. Television transmissions in the United States typically use horizontal polarization.

Present day omnidirectional horizontally polarized antennas, such as turnstile dipoles, wire loops and slotted cylinders, may be considered to have limited bandwidth. For example, U.S. Pat. No. 6,414,647 to Lee discloses a circularly polarized slot-dipole antenna, where the slot and the dipole are located in the same physical structure. The antenna includes two substantially cylindrical members with a slot located on the outer surface of the antenna.

Inventorship of the Biconical Dipole Antenna has been attributed to Sir Oliver Lodge in U.S. Pat. No. 609,154 in the year 1898. Wire cage conical monopole antennas were used by 1905, at the Marconi Transatlantic Stations. Later, a biconical dipole antenna including a coaxial feed structure, was disclosed in U.S. Pat. No. 2,175,252 to Carter entitled "Short Wave Antenna". These antennas all included curved surfaces, from at least one figure of rotation.

Excitation of biconical dipoles is accomplished by imparting an electrical potential across the apex of the two opposing cones, causing a TEM mode. This mode is analogous to the $TE_{01}$ mode of sectoral horns, but as the biconical dipole is a complete figure of revolution, symmetric about the cone axis, the TEM mode results. In a sectoral horn, a monopole probe is commonly used for excitation. In a biconical dipole, excitation is by the dipole moment formed across the horn walls (opposing cones), so the structure is self exciting. A biconical dipole antenna is an example of an omnidirectional vertically polarized antenna of relatively great bandwidth.

$TE_{10}$ modeling of conventional biconical dipole structures has been proposed for the purpose of horizontal polarization and omnidirectional radiation. In one instance, a circle of wire operates as loop antenna and excitation probe, and is placed normal to the bicone axis (Chu et. al., "Biconical Electromagnetic Horns", Proceedings of the IRE, Vol. 27, page 769, December 1939). In this approach, the cones act only as horn walls and they are not self exciting. Gain bandwidth of this system is limited, due to the narrow bandwidth of the wire loop probe.

Loop antennas relate to circles, and they can be open or closed, as in the hole of wire loop or the solid center of a metal disc antenna. Current can be conveyed in a circle, as around the rim of metal disc, the periphery of a hole in a metal sheet, or along a circular ring of wire. Solid planar loop antennas not having an open aperture, formed in or of a metal sheet, are slot antennas and operate according to Babinet's Principle. Slot antennas can be either loop or dipole, according to their shapes, as circles or lines.

Antennas then, can be divided into two canonical forms including the dipole antenna and the loop antenna, which correspond to the capacitor and inductor of RF electronics, having radial near fields that are electric or magnetic respectively. Thus, radiation may be caused by two distinct mechanisms including separation of charge in dipoles and conveyance of charge in loops. The dipole relates to the line while the loop relates to the circle. While broadband dipoles are known in the art, for example, the biconical and bowtie dipoles, the broadband forms of loop antennas have largely been unknown.

A dual to the biconical dipole has recently been identified, and is disclosed in U.S. Patent application publication number 2007/0159408 A1 entitled "Broadband Omnidirectional Loop Antenna and Associated Methods". In this antenna, horizontal polarization is obtained by inverting the cones of a biconical dipole, forming a Biconical Loop Antenna, whose structure becomes a substrate for surface waves. RF currents are conveyed circularly on the biconical loop antenna and radially on the biconical dipole. Some engineering requirements may however require an antenna with planar surfaces rather than curved surfaces, such as to realize a horizontally polarized radiation from an antenna that folds apart for storage.

Modern military systems may include the need to control radar cross section (RCS). Low RCS antenna requirements may pose special challenges; antennas can be both an aperture for radiation and an aperture for scattering radar energy. For instance, an antenna forms an effective radar reflector at its resonant frequency when its terminals are short circuited (Christion G. Bachman, "Radar Targets", copyright 1982 Lexington Books, pp 75, FIG. 2-2).

It is perhaps common to locate antennas internally or externally to portable electronics communications devices, say a radio pager or a portable radio. It may be however advantageous if the radio housing forms the antenna, such that no internal volume is lost from the radio, or that no external protuberances cause the radio to become unweildly. It is to this need, for an electronics housing antenna, that this invention is also directed.

The conical and spatial, or 3-D volumetric form, of dipoles is well known, being the biconical dipole antenna. However, there is a need for a broadband omnidirectional horizontally polarized antenna that may be foldable or have a relatively low RADAR observability. Further, there is a need for an antenna that forms a housing for the inclusion of electronics.

SUMMARY OF THE INVENTION

In view of the foregoing background, it is therefore an object of the present invention to provide a broadband, omnidirectional, horizontal polarization antenna that has a low radar cross section.

This and other objects, features, and advantages in accordance with the present invention are provided by an antenna including an electrically conductive antenna body having a polyhedral shape with opposing first and second ends and a medial portion therebetween. The medial portion of the electrically conductive antenna body is wider than the opposing first and second ends thereof, and the electrically conductive antenna body has a slot therein extending from at least adjacent the first end to at least adjacent the second end.

The electrically conductive antenna body may include a plurality of electrically conductive planes arranged in the polyhedral shape, and the slot may be defined between opposing edges of adjacent electrically conductive planes. Antenna feed points may be provided at the medial portion of the polyhedral antenna body adjacent the slot.

The polyhedral antenna body may include first and second polyhedral body portions connected together at the medial portion of the polyhedral antenna body. The first polyhedral body portion may comprise a plurality of triangularly shaped electrically conductive planes, and/or the second polyhedral body portion may comprise a plurality of triangularly shaped electrically conductive planes. Each of the triangularly shaped electrically conductive planes may be a continuous conductive layer or a dielectric substrate and an electrically conductive trace thereon.

The electrically conductive antenna body may be a hollow polyhedral antenna body or a solid antenna body with the slot extending from a central axis of the antenna body to an exterior surface thereof. Also, a dielectric material may be provided in the slot of the polyhedral antenna body.

A method aspect of the invention is directed to making an antenna including forming an electrically conductive antenna body having a polyhedral shape with opposing first and second ends and a medial portion therebetween. The medial portion of the electrically conductive antenna body is wider than the opposing first and second ends thereof. The method includes forming at least one slot extending from at least adjacent the first end to at least adjacent the second end of the electrically conductive antenna body.

Forming the electrically conductive antenna body may comprise arranging a plurality of electrically conductive planes in the polyhedral shape, and forming the at least one slot may comprise defining the slot between opposing edges of adjacent electrically conductive planes. Forming the electrically conductive antenna body may include forming first and second polyhedral body portions each having an apex and a base opposite the apex, the bases being connected together to define the medial portion of the electrically conductive antenna body. Forming the at least one dielectric slot may comprise extending the slot from the apex of the first polyhedral body portion to the apex of the second body portion, and the method may further include defining feed points adjacent the slot at the medial portion of the polyhedral antenna body.

Forming the polyhedral body portions may comprise forming each of the first and second polyhedral body portions as a continuous conductive layer or as a dielectric substrate and an electrically conductive trace thereon.

Conventional types of omnidirectional horizontally polarized antennas, such as turnstiled dipoles, wire loops and slotted cylinders all have limited bandwidth. The polyhedral loop antenna has an omnidirectional pattern, is horizontally polarized and broad in bandwidth above a lower cutoff frequency.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
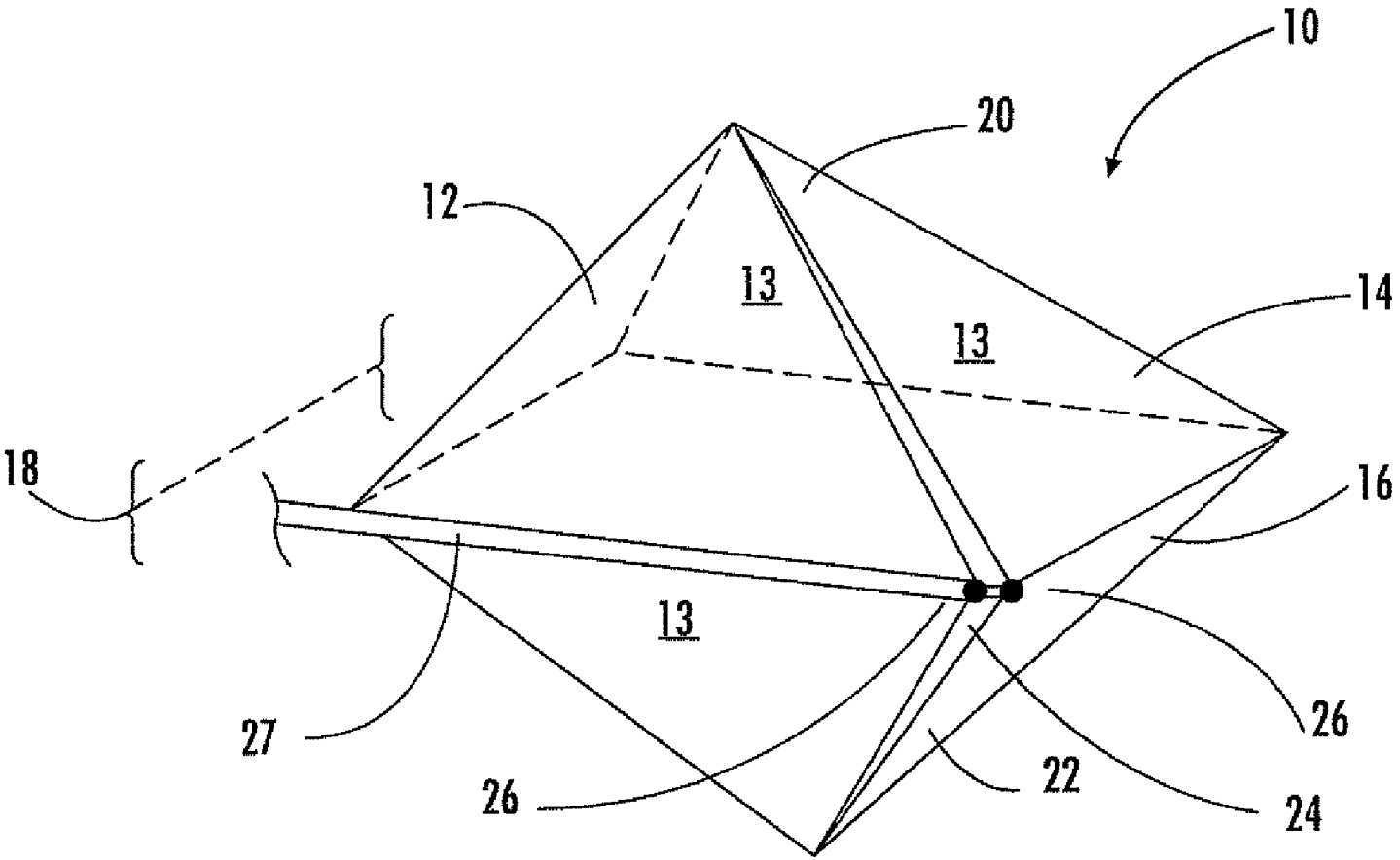
FIG. 1 is an isometric view of a polyhedral antenna according to the present invention.

Referring initially to FIG. 1, a polyhedral loop antenna 10 in accordance with the present invention will be described. The polyhedral loop antenna 10 includes an electrically conductive antenna body 12 with first and second polyhedral body portions 14, 16 connected together at a medial portion 18 of the antenna body. First and second opposing ends 20, 22 have the medial portion 18 therebetween. The antenna body 12 has a slot 24 extending from adjacent the first end 20 to adjacent the second end 22. The medial portion 18 of the antenna body is wider than the opposing ends.

Although the polyhedral loop antenna 10 depicted in FIG. 1 is an octahedron, or 8-sided polyhedron (composed of a 4-sided apex and corresponding 4-sided base), the polyhedral antenna is not limited to this geometric configuration. For example, the apex (and the corresponding base) can have an arbitrary number of flat sides (greater than two). The apex (and base) can have four sides, for example (thus forming a tetrahedron), or the apex can have three sides or any greater number of sides, thus allowing a great variety of polyhedral shapes.

The electrically conductive antenna body 12 illustratively includes a plurality of electrically conductive planes 13 arranged in the polyhedral shape, and the slot 24 is a linear gap defined between opposing edges of adjacent electrically conductive planes. Slot 24 may be used as a driving discontinuity for antenna excitation. The polyhedral loop antenna 10 may have an omnidirectional pattern and horizontal polarization, relatively low RADAR cross section (RCS).

Illustratively, a pair of antenna feed points 26 are at the medial portion 18 of the antenna body 12 and on either side of the slot 24. Various antenna feeds, such as a 50 ohm coaxial feed 27 (e.g. as shown in FIG. 1) or stripline feeds, and an associated feed network, can be connected at the feed points 26 to make the antenna an active element as would be appreciated by those skilled in the art. Jumpers may optionally be included along slot 24, to modify harmonic resonances.

The panels 13 of one or both of the first and second polyhedral body portions 14, 16 may be triangularly shaped, for example, as depicted in FIG. 1, together defining the body 12 as an octahedron. Such pyramidal body portions each have an apex, at the first and second opposing ends 20, 22 and a base opposite the apex. The bases are connected together to define the medial portion 18 of the antenna body 12. Other shaped panels 13 are also contemplated, and antenna body 12 may contain any number of panels. The panels 13 may, for instance, include various shapes (not necessarily triangular), and the panels may not necessarily all be the same size.

The antenna body 12 may be hollow or a solid. In the solid antenna body, the slot 24 also extends from a central axis of the antenna body 12 to an exterior surface thereof, and the slot 24 forms a half plane of discontinuity.

The antenna body 12 may be made from a continuous conductive layer such as copper or brass sheet metal, for example. Alternatively, the antenna body 12 may be a meshed wire or cage structure, such as a lattice of metal wires. A dielectric material, such as air or any other suitable dielectric, may be in the slot 24 of the antenna body 12, and the slot defines a slotted transmission line (STL) along its extent.

The slot 24 may be a vertical slot for horizontal polarization (as illustrated in FIG. 1). However, the slot may alternatively be horizontal for vertical polarization. Crossed slots 24 may be provided for circular polarization, fed in phase quadrature (0 and 90 degrees out of phase) as are common for dipole turnstiles.

The example of the antenna 10 is representative in nature, and it may be tailored for various purposes, such as by varying height to diameter ratios, slot length, driving points, etc., as will be apparent to those skilled in the art. For example, moving the driving points along the slot 24 can adjust the resistance obtained at resonance.

Figure 2:
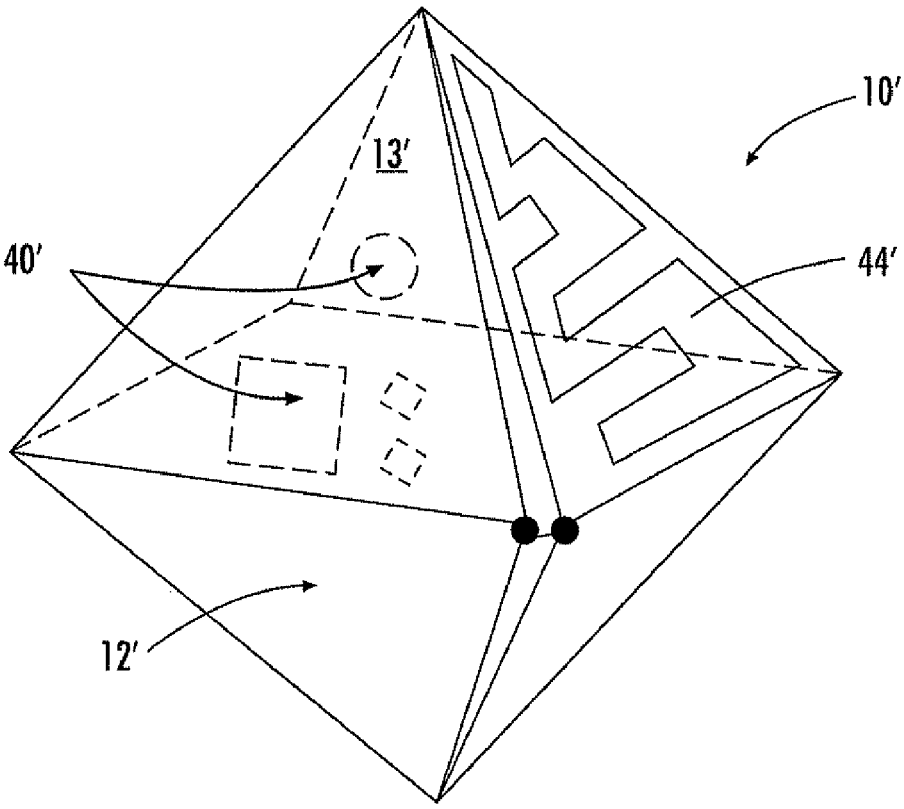
FIG. 2 is an isometric view of another embodiment of the polyhedral antenna according to the present invention.
Figure 3:
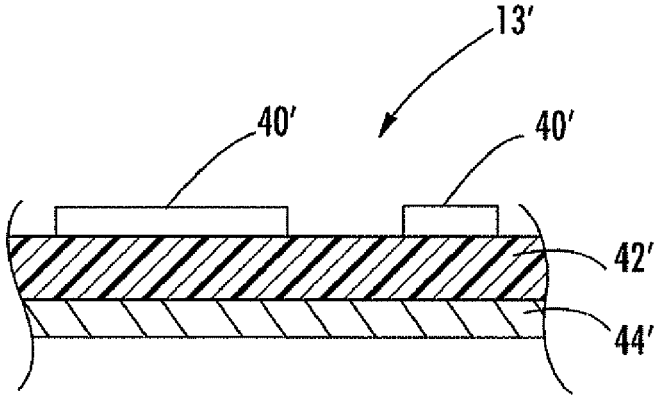
FIG. 3 is a cross-sectional view of a panel of the antenna body of the antenna of FIG. 2.

Due to the polyhedral shape of the antenna 10, the antenna body 12 may also serve as a fold-up electronics housing, e.g. enclosing associated transmitter/receiver electronics. For example, referring to another embodiment of the antenna 10', illustratively shown in FIG. 2, circuitry 40' comprising at least one active electronic component, such as a radio, may be mounted within the antenna body 12' on one or more of the panels 13'. Each of the plurality of panels 13' may comprise a printed circuit board 42' on the side internal to the antenna body 12' and comprise a surface for an electrically conductive metallization layer 44' on the (other) side external to the antenna body, for example, as also shown in the cross-sectional view of FIG. 3.

The polyhedral loop antenna 10 may be excited by ways other than slot 24, such as a gamma match, as is common for dipoles, and the driven elements of yagi-uda antennas. Antenna body 10 is therefore not dependent upon the slot 24 to radiate; other ways of excitation may be used. Antenna body 12 may for instance operate as a parasitic element in an array. It is only necessary that a current flow around the circumference of body 12 to transduce electromagnetic fields. The polyhedral loop antenna 10 can be thought to have a driving plane of discontinuity through the central axis of the polyhedral antenna body 12. Slot(s) 24 correspond to these planes of discontinuity. (If only one slot 24 is configured, the driving discontinuity is then a half plane).

A method aspect of the invention is directed to making an antenna 10 including forming an electrically conductive antenna body 12 having a polyhedral shape with opposing first 20 and second 22 ends and a medial portion 18 therebetween. The medial portion 18 of the electrically conductive antenna body 12 is wider than the opposing first and second ends thereof. The method includes forming at least one slot 24 extending from at least adjacent the first end 20 to at least adjacent the second end 22 of the electrically conductive antenna body 12.

Forming the electrically conductive antenna body 12 may comprise arranging a plurality of electrically conductive planes 13 in the polyhedral shape, and forming the at least one slot 24 may comprise defining the slot between opposing edges of adjacent electrically conductive planes. Forming the electrically conductive antenna body 12 may include forming first and second polyhedral body portions 14, 16 each having an apex and a base opposite the apex, the bases being connected together to define the medial portion 18 of the electrically conductive antenna body.

Forming the at least one dielectric slot 12 may comprise extending the slot from the apex of the first polyhedral body portion 20 to the apex of the second body portion 22, and the method may further include defining feed points 26 adjacent the slot 24 at the medial portion 18 of the polyhedral antenna body 12. Forming the polyhedral body portions 20, 22 may comprise forming each of the first and second polyhedral body portions as a continuous conductive layer or as a dielectric substrate 42' and an electrically conductive trace thereon 44'.

Figure 4A:
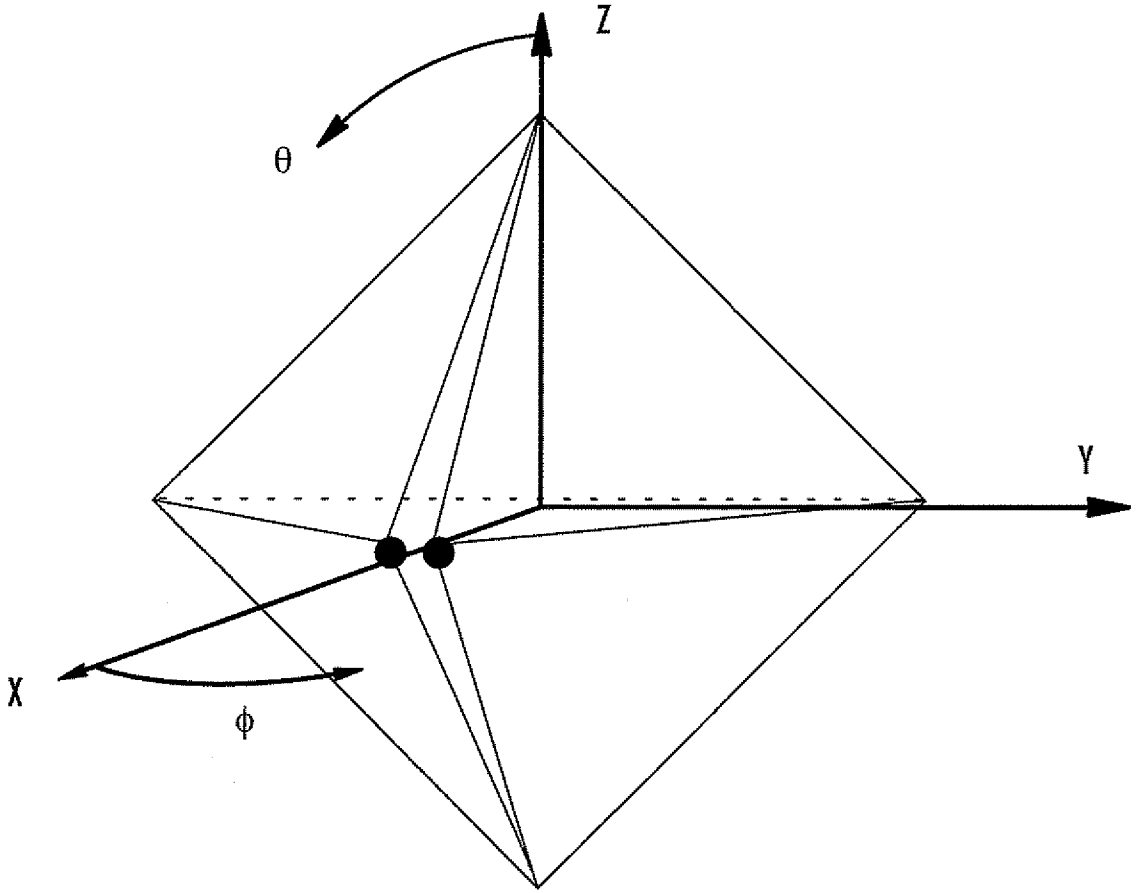
FIG. 4A is an isometric view of the antenna of FIG. 1, in the radiation pattern coordinate system.
Figure 4B:
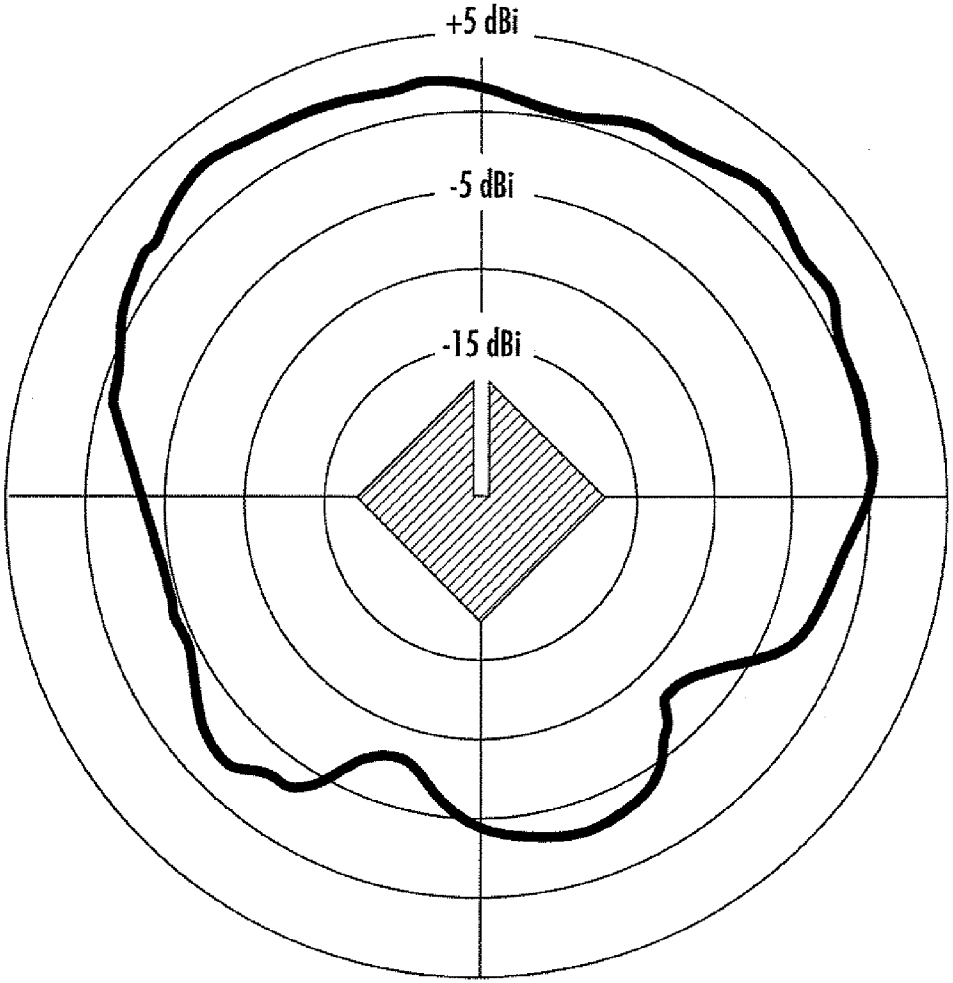
FIGS. 4B-4C are measured XY and YZ plane far field radiation patterns of an example of present invention antenna.
Figure 4C:
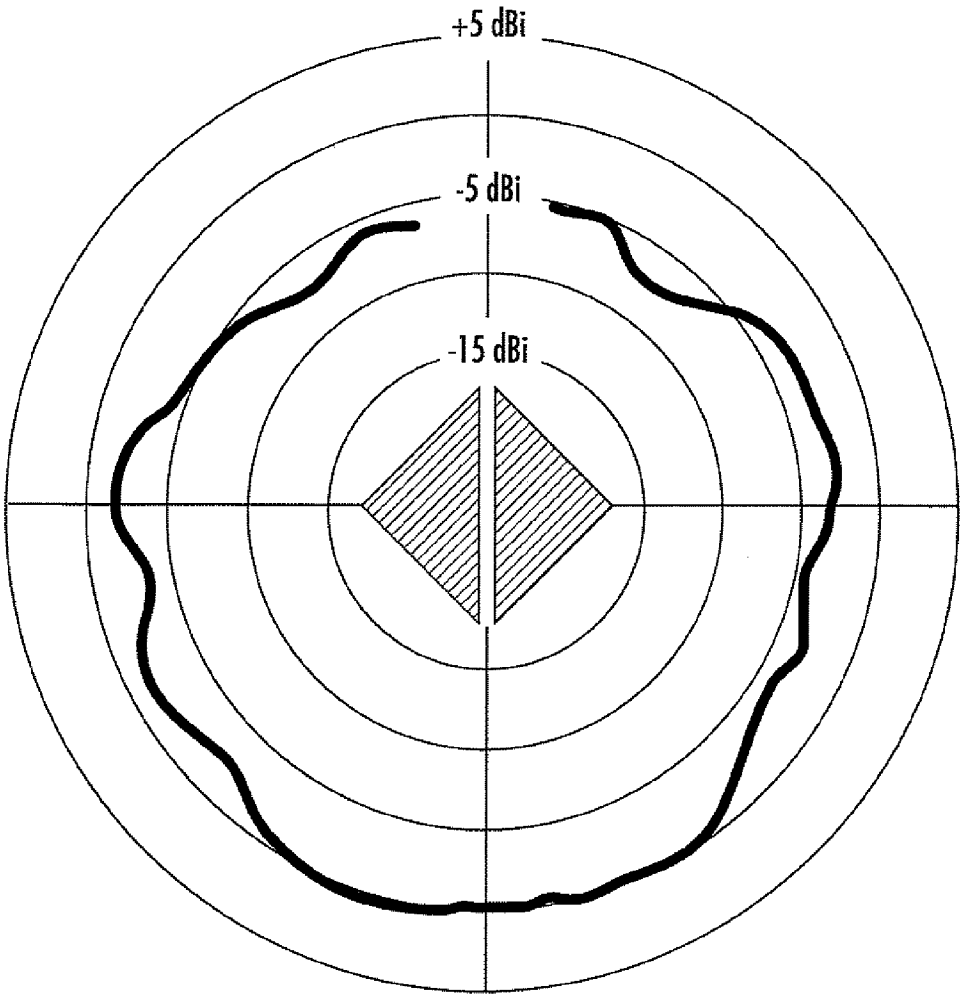

FIG. 4A depicts the polygon antenna in a standard radiation pattern coordinate system. FIGS. 4B-4C are measured XY and ZX plane far field radiation patterns for an octahedral embodiment of the present invention polyhedral antenna 10 at $1^{st}$ resonance. Edges of the example structure were 0.39 wavelengths in length and the total length of the driven slot was 0.78 wavelengths, corresponding to two edges. At small electrical sizes, the radiation pattern of the present invention becomes similar to the two petal rose of ½ wave dipoles, and includes an omnidirectional pattern in one plane. At larger electrical sizes for the polygon antenna 10, the radiation pattern may become more directive with radiation favored on the slot side of structure. This may be akin to the patterns of slotted cylinder antennas ("The Patterns Of Slotted-Cylinder Antennas", George Sinclair, Proceedings of the IRE, December 1948, pp 1487-1492).

Methodologies for calculation of gain of the present invention may relate to the slot form of dipole and loop antennas, Babinet's Principle and Bookers Relation. Since the driving discontinuity may be a half plane, currents formed around the polygon loop antennas 10 circle back or "loop". When polyhedral loop antenna body 10 is electrically small or at fundamental resonance, current flow around polyhedral loop body 10 is significant and the structure as a whole may behave similarly to the 3 dimensional loop antennas, such as the Slotted Cylinder Antenna (for instance, as disclosed in U.S. Pat. No. 7,079,081).

Figure 5:
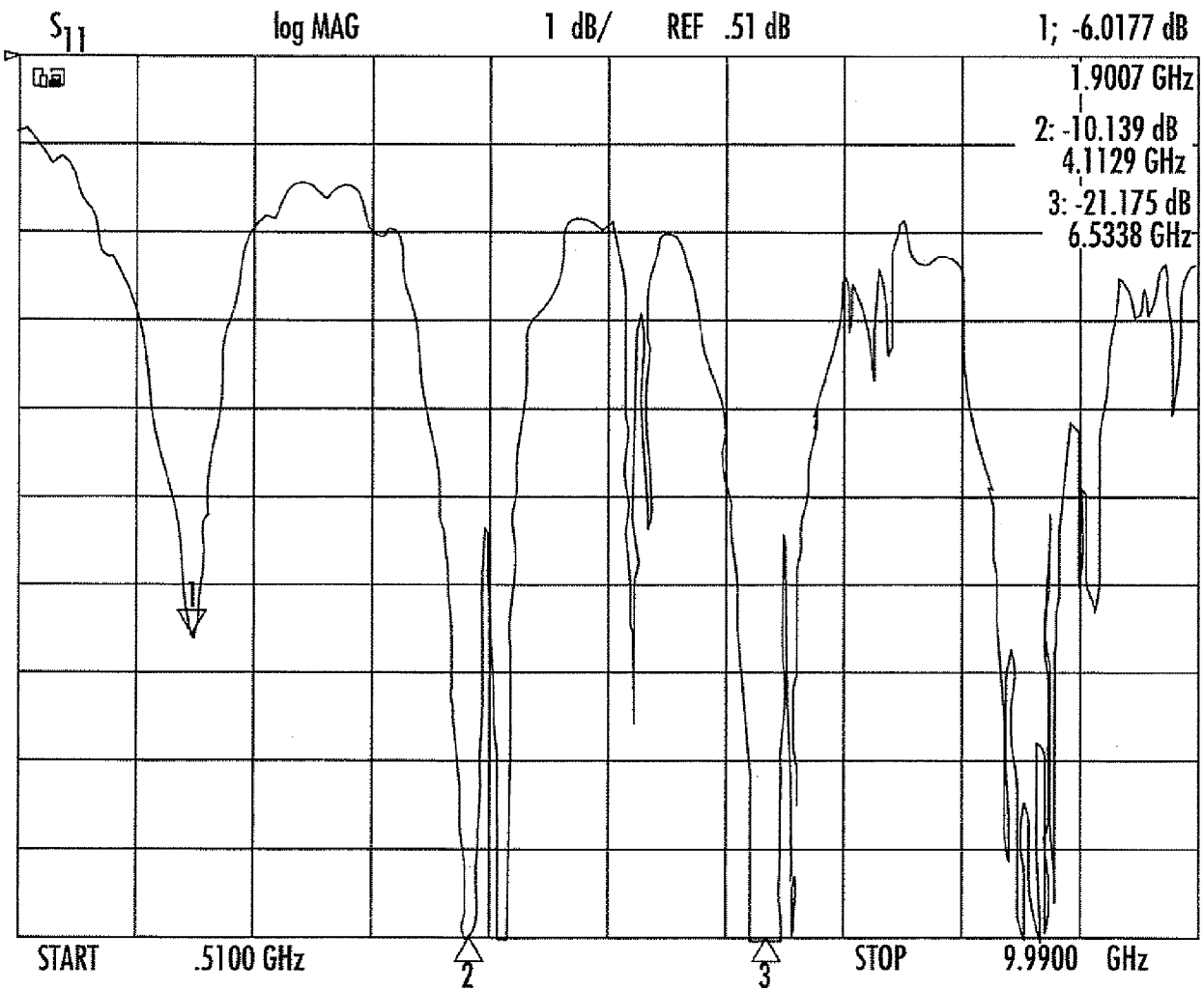
FIG. 5 is a plot of the return loss (S11) of an example of the present invention antenna.

FIG. 5 is a plot of the measured input return loss ($20\ LOG_{10}$ $|S11|$ dB) of an octahedral embodiment of an example of the polyhedral antenna 10. The structure was driven across the center of the driving discontinuity (slot) and measured in a 50 ohm system. The driving point location along the slot discontinuity may be varied to control resistance obtained at resonance. This was observed to occur without significant change to radiation pattern.

FIGS. 5A-5C depict a tetrahedral embodiment 32 of the polyhedral loop antenna 10, and the stages of a non limiting method of fold-together construction, which may be preferable for field deployment, or compact storage of the unfolded antennas, for example. The planar substrate 36 may be a conductive material, or a nonconductive material with conductive layer(s), such as a printed wiring board (PWB), metalized liquid crystal polymer material (LCP PWB), or even paper with conductive ink. The polyhedral antenna may include electronic components 40 on the inside or outside surfaces of the antenna. Creases 38 may be embossed onto the planar substrate 36 to act as guidelines and to facilitate the start of the folds.

Such a broadband, horizontally polarized, omnidirectional antenna 10 with low visibility features may also be applicable as a beacon/radiolocation device, for use with Ship System Exploitation Equipment (SSEE), for use with UHF Advanced Deployable System (ADS) and/or as a scatterable unattended ground sensor (SUGS) antenna. Conductive planes 13 may be shiny in the visible spectrum, E.G. mirrored, such as to provide visual camouflage by reflecting select portions of the operating environment back to the viewer.

An antenna used for receiving or transmitting incurs a resistive load at its terminals. When the antenna is properly matched, the antennas RCS can be 50 percent that of a shorted terminal antenna. Thus, it is problematic if not fundamentally limited for an antenna to simultaneously exhibit low RCS and be effective as an antenna on the same frequency. Antenna RCS reduction may more readily be accomplished away from the antennas operating frequency, and it is to this need that the present invention is primarily directed. Calculation of RCS may be made from the antenna gain of the present invention as:

$$\sigma=G^2\lambda^2/4\pi$$

where $\sigma$=radar scattering cross section in square meters ($m^2$)

G=antenna gain with respect to isotropic=$10^{(gain\ in\ dBi/10)}$ $\lambda$=wavelength in meters (m)

and $$\sigma \text{ in dBsm}=10\ \text{LOG}_{10}\ (\sigma \text{ in meters})$$

An example, for small electrical size of the present invention, where the gain would approach 1.5 (or 1.76 dBi), the RCS would be 0.119 meters squared at $\lambda$=1 meter.

Figure 6C:
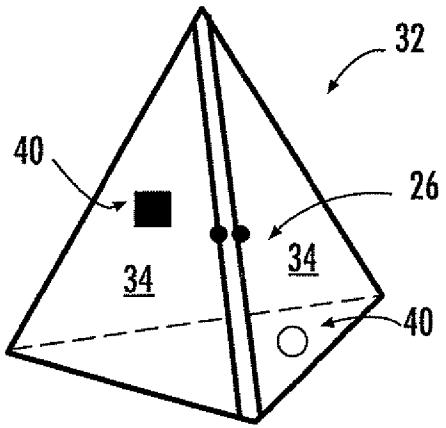
FIGS. 6A-6C are schematic diagrams illustrating fold together construction of a tetrahedral embodiment of the present invention antenna.
Figure 6B:
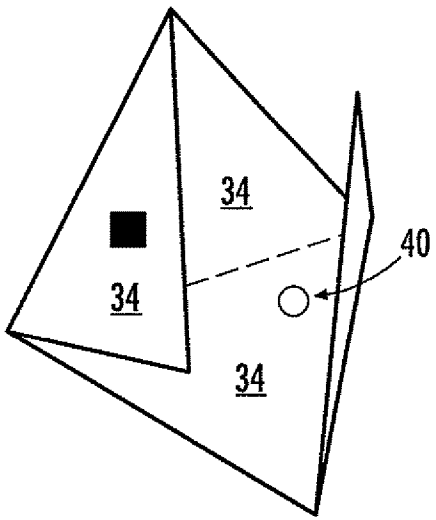
Figure 6A:
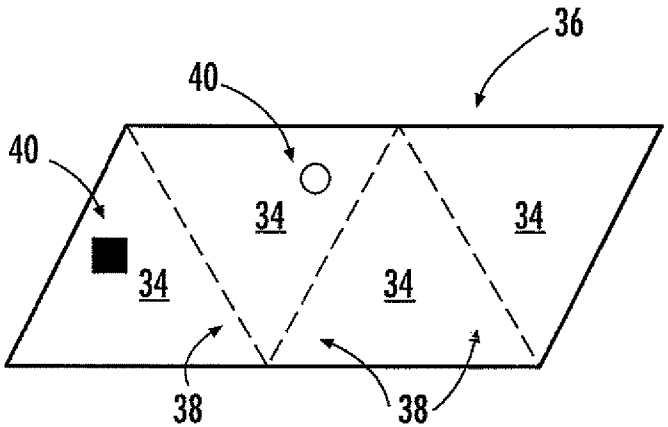
Figure 7:
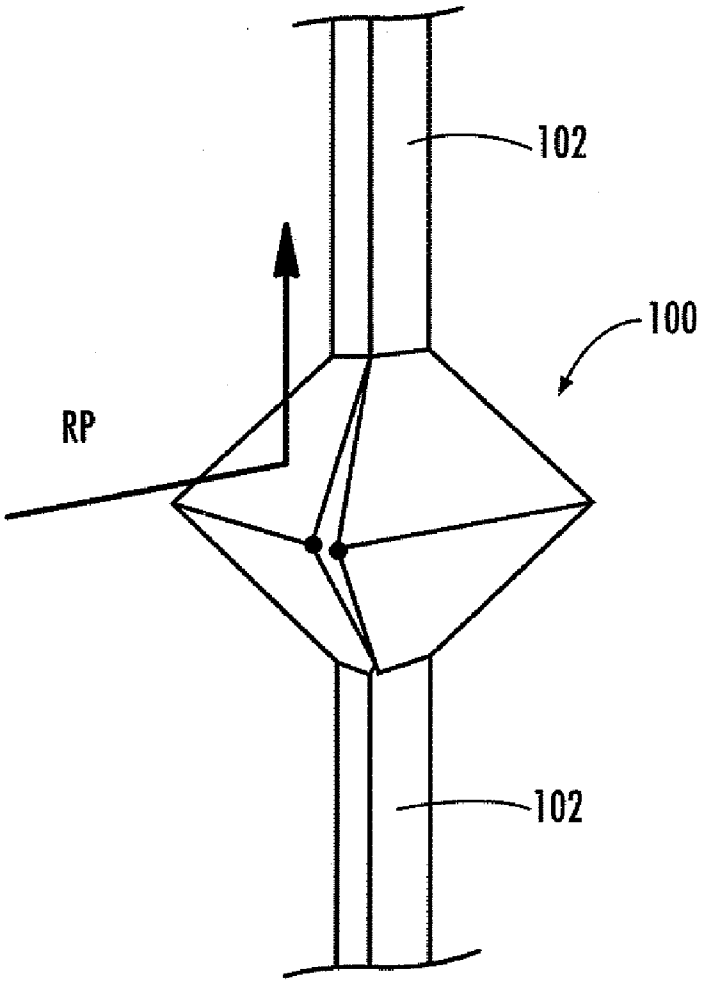
FIG. 7 is a perspective view of a ship mast including an antenna in accordance with features of the present invention.

As an example, referring to FIG. 6, a polyhedral loop antenna 100 in accordance with features of the present invention, may be used on a ship's mast 102. The ray path RP of a monostatic RADAR is shown being scattered from one of the polyhedral surfaces at an angle away from the horizon. As may be apparent, the echo is not retroflective back to the source at physical optics frequencies where the polyhedral antenna is electrically large. Reflections from the polygon loop antenna 10 are primarily specular when the antenna structure is large relative to wavelength.

The apexes of the conical elements of a conventional biconical dipole antenna are adjacent each other, but in the polyhedral loop antenna 10, it is the mouths or bases of the body portions that are adjacent each other. The slot or open seam along the body portions creates an electrical discontinuity for excitation and functions as a slotted transmission line (STL) or "slotline".

Thus, a low radar cross section antenna is provided by a polyhedron structure, slots therein form discontinuities serving as antenna driving points, and the flat surfaces thereupon provide specular reflections at physical optics region frequencies. The polyhedron antenna structure may form an electronics housing and be foldable for deployment, stowage, or economy of manufacture. Optical camouflage may be provided by mirroring the antennas planar surfaces.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

an electrically conductive antenna body having a polyhedral shape with opposing first and second ends and a medial portion therebetween;

the medial portion of said electrically conductive antenna body being wider than the opposing first and second ends thereof; and the electrically conductive antenna body having a slot therein extending from at least adjacent the first end to at least adjacent the second end.

2. The antenna according to claim 1 wherein the electrically conductive antenna body comprises a plurality of electrically conductive planes arranged in the polyhedral shape; and wherein the slot is defined between opposing edges of adjacent electrically conductive planes.

3. The antenna according to claim 1 further comprising antenna feed points at the medial portion of the polyhedral antenna body adjacent the slot.

4. The antenna according to claim 1 wherein the polyhedral antenna body comprises first and second polyhedral body portions connected together at the medial portion of the polyhedral antenna body.

5. The antenna according to claim 4 wherein the first polyhedral body portion comprises a plurality of triangularly shaped electrically conductive planes.

6. The antenna according to claim 4 wherein each of the first and second polyhedral body portions comprises a plurality of triangularly shaped electrically conductive planes.

7. The antenna according to claim 6 wherein each of the triangularly shaped electrically conductive planes comprises a continuous conductive layer.

8. The antenna according to claim 6 wherein each of the triangularly shaped electrically conductive planes comprises a dielectric substrate and an electrically conductive trace thereon.

9. The antenna according to claim 1 wherein the electrically conductive antenna body comprises a hollow polyhedral antenna body.

10. The antenna according to claim 1 further comprising a dielectric material in the slot of the polyhedral antenna body.

11. A omnidirectional horizontally polarized antenna comprising:

an electrically conductive antenna body having a polyhedral shape and including first and second polyhedral body portions each having an apex and a base opposite the apex, the bases being connected together to define a medial portion of the antenna body;

the antenna body having a dielectric slot extending from the apex of the first polyhedral body portion to the apex of the second polyhedral body portion; and antenna feed points at the medial portion of the polyhedral antenna body adjacent the dielectric slot.

12. The antenna according to claim 11 wherein each of the polyhedral body portions comprises a plurality of electrically conductive planes.

13. The antenna according to claim 12 wherein each of the electrically conductive planes comprises a continuous conductive layer.

14. The antenna according to claim 11 wherein the electrically conductive antenna body comprises a hollow antenna body.

15. A method of making an antenna comprising:

forming an electrically conductive antenna body having a polyhedral shape with opposing first and second ends and a medial portion therebetween;

the medial portion of said electrically conductive antenna body being wider than the opposing first and second ends thereof; and forming at least one slot extending from at least adjacent the first end to at least adjacent the second end of the electrically conductive antenna body.

16. The method according to claim 15 wherein forming the electrically conductive antenna body comprises arranging a plurality of electrically conductive planes in the polyhedral shape; and wherein forming the at least one slot comprises defining the slot between opposing edges of adjacent electrically conductive planes.

17. The method according to claim 15 wherein forming the electrically conductive antenna body includes forming first and second polyhedral body portions each having an apex and a base opposite the apex, the bases being connected together to define the medial portion of the electrically conductive antenna body; and wherein forming the at least one dielectric slot comprises extending the slot from the apex of the first polyhedral body portion to the apex of the second body portion; and further comprising defining feed points adjacent the slot at the medial portion of the polyhedral antenna body.

18. The method according to claim 17 wherein forming the polyhedral body portions comprises forming each of the first and second polyhedral body portions as a continuous conductive layer.

19. The method according to claim 17 wherein forming the polyhedral body portions comprises forming each of the first and second polyhedral body portions as a dielectric substrate and an electrically conductive trace thereon.

* * * * *